US010934796B2

(12) United States Patent
Stephenson et al.

(10) Patent No.: US 10,934,796 B2
(45) Date of Patent: Mar. 2, 2021

(54) METHOD FOR REMOVING CASING FROM A WELLBORE

(71) Applicant: Deep Casing Tools, Ltd., Aberdeen (GB)

(72) Inventors: David John Stephenson, Aberdeen (GB); Tomasz Jozef Walerianczyk, Tarnowiec (PL); Neil Andrew Abercrombie Simpson, Aberdeen (GB)

(73) Assignee: Deep Casing Tools, Ltd., Aberdeen (GB)

( * ) Notice: Subject to any disclaimer, the term of this patent is extended or adjusted under 35 U.S.C. 154(b) by 0 days.

(21) Appl. No.: 16/191,862

(22) Filed: Nov. 15, 2018

(65) Prior Publication Data

US 2019/0345787 A1 Nov. 14, 2019

Related U.S. Application Data

(60) Provisional application No. 62/669,519, filed on May 10, 2018.

(51) Int. Cl.
*E21B 29/00* (2006.01)

(52) U.S. Cl.
CPC ..... *E21B 29/00* (2013.01)

(58) Field of Classification Search
CPC ..... E21B 29/00; E21B 43/105; E21B 43/10; E21B 43/108
See application file for complete search history.

(56) References Cited

U.S. PATENT DOCUMENTS 5,348,095 A * 9/1994 Worrall ..... E21B 7/20 166/380
7,121,351 B2 * 10/2006 Luke ..... E21B 29/10 166/382
2004/0055786 A1 3/2004 Maguire et al.
2007/0017675 A1 * 1/2007 Hammami ..... E21B 33/13 166/278
2017/0122053 A1 * 5/2017 Braddick ..... E21B 23/01

FOREIGN PATENT DOCUMENTS

WO 02038343 A2 5/2002
WO 030006790 A1 1/2003
WO 030036026 A1 5/2003

OTHER PUBLICATIONS

International Search Report and Written Opinion, International Application No. PCT/IB2019/052927 dated Aug. 26, 2019.

* cited by examiner

*Primary Examiner* — David J Bagnell
*Assistant Examiner* — Yanick A Akaragwe
(74) *Attorney, Agent, or Firm* — Richard A. Fagin

(57) ABSTRACT

A method for recovering a conduit from a wellbore includes positioning an expander tool having at least one biasing element within the conduit an expander tool and exerting a force against the at least one biasing element to radially expand the conduit to an amount sufficient to fracture solids outside of and in contact with the conduit.

18 Claims, 5 Drawing Sheets

METHOD FOR REMOVING CASING FROM A WELLBORE

CROSS REFERENCE TO RELATED APPLICATIONS

Priority is claimed from U.S. Provisional Application No. 62/669,519 filed on May 10, 2018 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates generally to the field of recovering conduit from a wellbore. More specifically, this disclosure relates to a method of removing casing that has been cemented to a wellbore by elastically deforming the casing.

In the oil and gas industry, wellbores drilled to exploit hydrocarbons in a reservoir are typically lined with conduit (which may include steel casing, tubulars, conductors and liners). Conduit may be inserted into a wellbore sequentially, with the section of conduit nearest the surface having a larger diameter (circumference) than sections of conduit located further along the longitudinal dimension of the wellbore (i.e., "downhole"). Multiple sections of conduit may overlap, such that an axial length of one conduit section having larger diameter will circumscribe a second section of conduit having smaller diameter. Once a section of conduit has been inserted into the wellbore, cement may be pumped into the annulus between the conduit and the wellbore, and into the annulus between sequential, longitudinally overlapping sections of conduit, in order to hold the conduit in place relative to the surrounding rock formations.

When production operations have drained the subsurface reservoir such that the well is no longer economically serviceable, the general practice is to decommission the wellbore. During decommissioning, sometimes referred to as plug-and-abandonment (P&A) work, a number of pressure-proof barriers (including cement plugs) are set in the wellbore between the subsurface reservoir and the surface. When setting the pressure-proof barriers, the operator often must remove longitudinally overlapping sections of conduit in order to create an effective barrier across the wellbore.

Because at least part of the conduit has been cemented in place, often for longer than thirty years, its removal is often costly and time-intensive. While methods for cutting and removing short sections of conduit exist, there continues to be a need for improved methods of recovering conduit from a wellbore.

SUMMARY

A method for recovering a conduit from a wellbore according to one aspect of the present disclosure includes positioning an expander tool comprising at least one biasing element within the conduit and exerting a force against the at least one biasing element to radially expand the conduit to an amount sufficient to fracture solids outside of and in contact with the conduit.

Some embodiments further comprising removing the conduit from the wellbore.

In some embodiments, the solids comprise at least one of cement, mud solids, formation solids, dissolved solids, barite weighting materials or organic materials.

In some embodiments, the conduit is a casing, tubular, conductor or liner.

In some embodiments, at least part of the conduit is circumscribed by a second conduit.

In some embodiments, the expander tool is rotatable about its longitudinal axis.

In some embodiments, the at least one biasing element is rotatable about a longitudinal axis of the expander tool.

Some embodiments further comprise rotating the at least one biasing elements about a longitudinal axis of the expander tool.

Some embodiments further comprise rotating the at least one biasing element about a circumferential axis of the expander tool.

Some embodiments further comprise disposing the at least one biasing element diametrically along an axial plane of the expander tool.

Some embodiments further comprise disposing a plurality of biasing elements radially around a center axis of the expander tool.

In some embodiments, a plurality of biasing elements extends radially outward from an outer circumference of the expander tool.

In some embodiments, an axis of rotation of the at least one of the biasing element is oriented at an angle with respect to a longitudinal axis of the expander tool in order to provide an axial force component in a direction of the wellbore conduit.

In some embodiments, the exerting is in an outward radial direction.

In some embodiments, the exerting comprises a longitudinal component.

In some embodiments, the force is exerted by means located within a through bore of the expander tool.

In some embodiments, the force is exerted by means disposed along a longitudinal axis existing radially inward from an outer radius of the expander tool.

Some embodiments further comprise applying a torque to the expander tool.

In some embodiments, the moving is rotational.

In some embodiments, the moving is axial.

Some embodiments further comprise connecting the expander tool to a downhole assembly.

In some embodiments, the radially expanding is limited to an elastic yield point of the conduit.

In some embodiments, the radially expanding is limited to an amount such that after plastic deformation the conduit is freely movable longitudinally along the wellbore.

BRIEF DESCRIPTION OF THE DRAWINGS

The accompanying drawings, described below, illustrate typical embodiments according to the present disclosure and are not to be considered limiting of the scope of the disclosure, for the disclosure may admit to other equally effective embodiments. The figures are not necessarily to scale, and certain features and certain views of the figures may be shown exaggerated in scale or in schematic in the interest of clarity and conciseness.

DETAILED DESCRIPTION

Figure 1A:
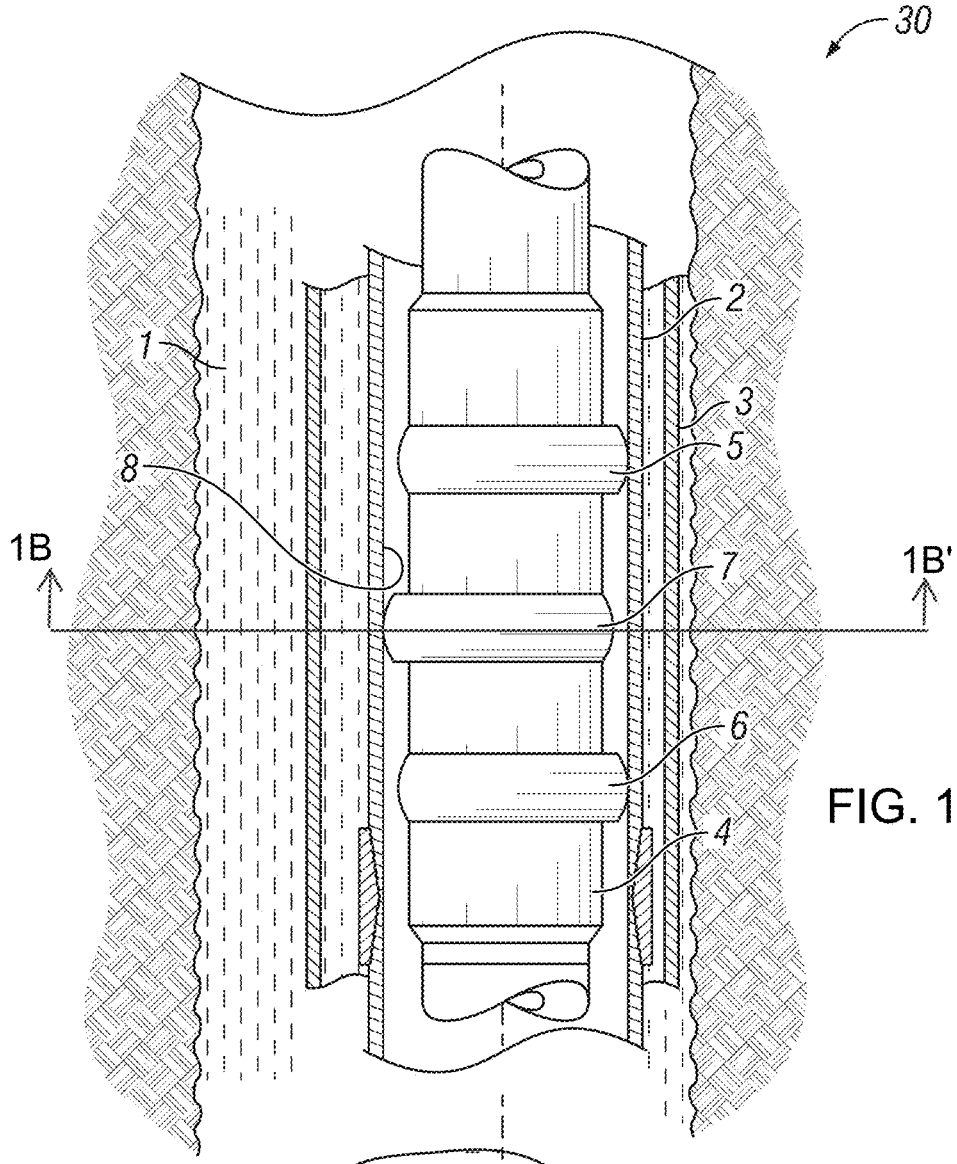
FIG. 1A is a side view sketch.
Figure 1B:
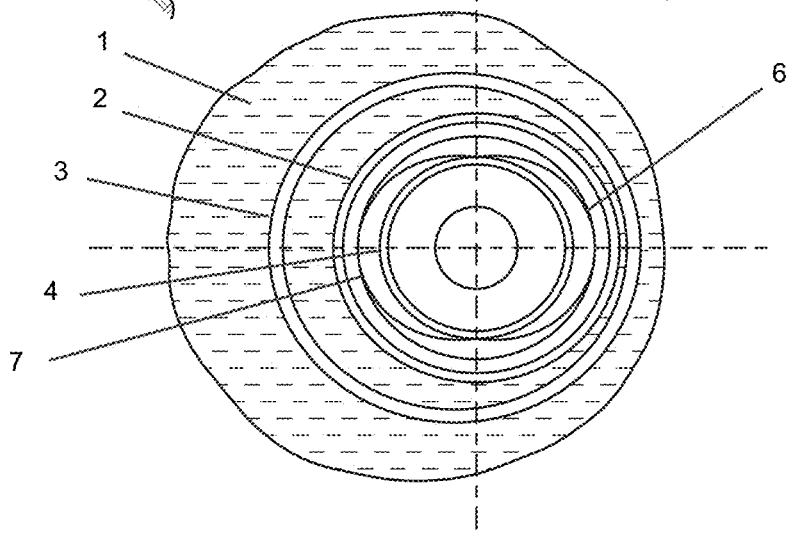
FIG. 1B is a cross sectional view, of a rotary expander tool deployed within the inner conduit of two eccentric conduits cemented to each other and cemented into the wellbore and a plan view sketch of the rotary expander tool and conduits within the wellbore.

FIG. 1A shows a rotary expander tool adapted to radially expand a conduit to fracture cement outside a wellbore conduit to facilitate removing the conduit from a wellbore. A side view of a wellbore 1 is shown wherein two nested conduits, an inner conduit and 2 and an outer conduit 3 having been cemented in place within the wellbore 1 and within formations 30 external to the wellbore 1. As shown, the rotary expander tool 4 may comprise two, radially fixed rotatable biasing elements 5 and 6 and one radially displaceable rotatable biasing element 7. In another embodiment, the rotary expander tool 4 may contain a plurality of radially displaceable, rotatable biasing elements. The rotary expander tool 4 is shown positioned downhole and proximate an inner wall 8 of the inner conduit 2. Solids such as cement, mud solids, formation solids, dissolved solids, barite weighting materials and organic materials may be present in the annular space between the inner conduit 2 and the outer conduit 3 in a completed well. A cross section of the foregoing is shown in FIG. 1B.

The radially fixed rotatable biasing elements 5, 6 and radially displaceable rotating biasing element 7 may be rotatable about an axis parallel to or along the longitudinal axis of the rotary expander tool 4 by means of rollers, bearings and the like.

The radially displaceable rotatable biasing element 7 is urged radially outward against the inner wall 8 of the inner conduit 2. The radially displaceable rotatable biasing element 7 may be urged radially outward by any biasing device, including means of electric or mechanical actuation such as springs, screws, fluid pressure operated pistons and levers. The outward radial force moves the rotary expander tool 4 off the center axis of the inner conduit 2 and may cause the radially fixed rotatable biasing elements 5 and 6 to engage the inner wall 8 of the inner conduit 2.

The radially displaceable rotatable biasing element 7 engages the inner conduit 2 with an outward radial force sufficient to radially expand the inner conduit 2 to an amount sufficient to fracture the cement, mud solids and/or formation solids disposed outside the inner conduit 2 and in contact with the outer surface of the inner conduit 2. In some embodiments, the radial expansion may be less than the material yield strength of the inner conduit 2, resulting in a reversible radial expansion of the inner conduit 2. In some embodiments, the radial expansion may be plastic and may be limited in extent such that the expanded inner conduit 2 may still freely pass through the interior of the outer conduit 3 and any part of the wellbore having no conduit, if such part exists.

The outward radial force exerted on the radially displaceable rotatable biasing element 7 may be accompanied by a force having a longitudinal component, such that the net force exerted by the radially displaceable rotatable biasing element 7 against the inner wall 8 of the inner conduit 2 contains both radial and longitudinal components.

While the radially displaceable rotatable biasing element 7 is forced radially outward, a torque may be applied to the rotate rotary expander tool 4 about its longitudinal axis, resulting in circumferential movement of the outward radial force along the inner wall 8. The rotary expander tool 4 may also be translated axially along its longitudinal axis, resulting in axial movement of the outward radial force along the inner wall 8. The circumferential stress along the inner wall 8 caused by such rotation and/or translation of the rotary expander tool 4 fractures solids and cement disposed in the annular space between the inner conduit 2 and the outer conduit 3, or in longitudinal sections of the wellbore having no outer conduit 3, between the inner conduit 2 and the formations 30. Such circumferential stress may also agitate and fluidize settled solids, for example, drilling fluid solids disposed in the space external to the inner conduit 2.

In some embodiments, the net circumferential stress exerted against the inner conduit 2 does not exceed the material yield strength of the inner conduit 2, the radial expansion of inner conduit 2 remains elastic and, when operations are complete, the radially displaceable rotatable biasing element 7 returns to its retracted position, and the outer circumference of the inner conduit 2 returns to its initial shape. In some embodiments, the inner conduit 2 may be permanently radially expanded, but to an extent still enabling the inner conduit 2 to be moved longitudinally within the outer conduit 3 and/or the wellbore 1.

Once the annular solids and cement in the annular space between inner conduit 2 and outer conduit 3 have been substantially disintegrated, the inner conduit 2 may be removed from the wellbore 1 using conduit cutting and pulling methods known in the art. Because the inner conduit 2 has not been permanently radially expanded, or has not been so radially expanded to an extent that it may not pass longitudinally through the outer conduit 3 and/or the wellbore 1, the inner conduit 2 may be recovered in larger sections and with a reduced amount of required force per unit length of the inner conduit 2.

In some embodiments, facture and/or disintegration of the solids may be followed by perforating and washing in the annular space outside the inner conduit 2 to remove fractured and/or disintegrated solids. Such removal may facilitate removal of the inner conduit 2.

Figure 2:
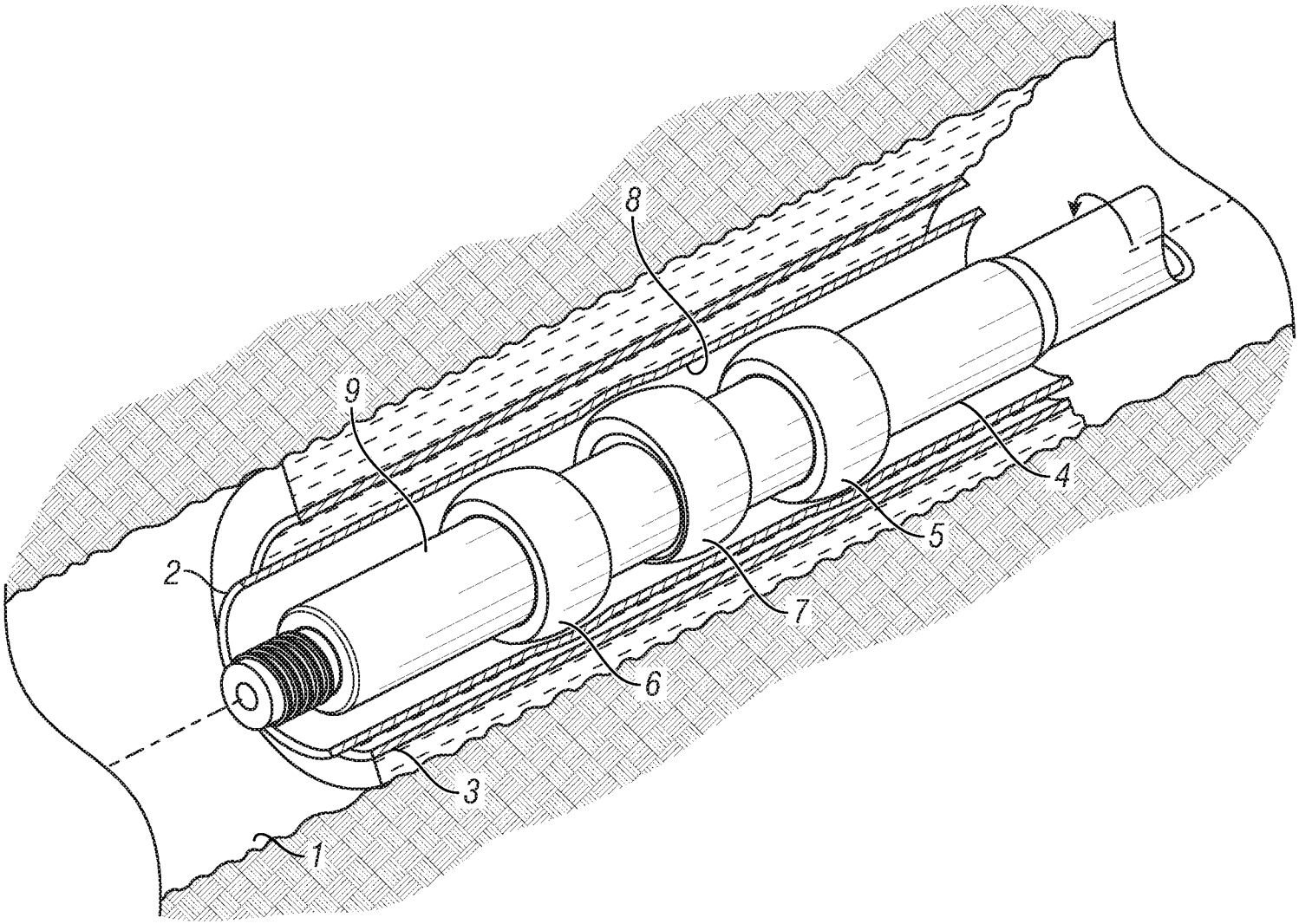
FIG. 2 is an isometric sketch of a rotary expander tool disposed in an inner casing bore of two eccentric conduits cemented within a section of wellbore and also cemented to each other.

FIG. 2 shows another view of an embodiment of a rotary expander tool adapted to fracture materials outside a conduit to facilitate removing conduit from within a wellbore. In the embodiment shown, the rotary expander tool 4 includes a cylindrical body 9 with a through bore disposed radially around the center axis of cylindrical body 9. Connections, such as threaded connections, on the proximate and distal ends of the rotary expander tool 4 allow for connection to a downhole assembly, which may be a drill string or work string.

A plurality of rotatable biasing elements 5, 6, 7 is disposed along and may extend radially outward from the circumference of cylindrical body 9 to contact a section of the inner conduit 2. One or more of the rotatable biasing elements 5, 6 and 7 may be disposed radially around the center axis of cylindrical body 9 and rotatable around a transverse plane having a larger circumference than the circumference of cylindrical body 9. In another embodiment, one or more of the rotatable biasing elements 5, 6 and 7 may be arranged longitudinally along the central axis of the cylindrical body 9 and rotatable about a longitudinal axis offset from the center axis of the cylindrical body 9.

As shown, one or more of the rotatable biasing elements 5, 6, and 7 is extensible radially outwardly from the center axis of the cylindrical body 9 as a result of a net outward force generated from within the through bore of the cylindrical body 9 and contacts an inner wall 8 of the conduit. A torque is applied to rotate the cylindrical body 9 relative to the inner conduit 2, resulting in circumferential movement of the net outward force exerted along the inner wall 8. At all times during the deployment of the one or more rotatable biasing elements 5, 6, and 7 and the rotation of cylindrical body 9, the net radial force remains below that of the material yield strength of the inner conduit 2.

In some embodiments, an axis of rotation of at least one of the rotatable biasing elements is oriented at an angle with respect to a longitudinal axis of the expander tool, i.e., the center axis of the cylindrical body, in order to provide an axial force component in a direction of the wellbore conduit.

Figure 3:
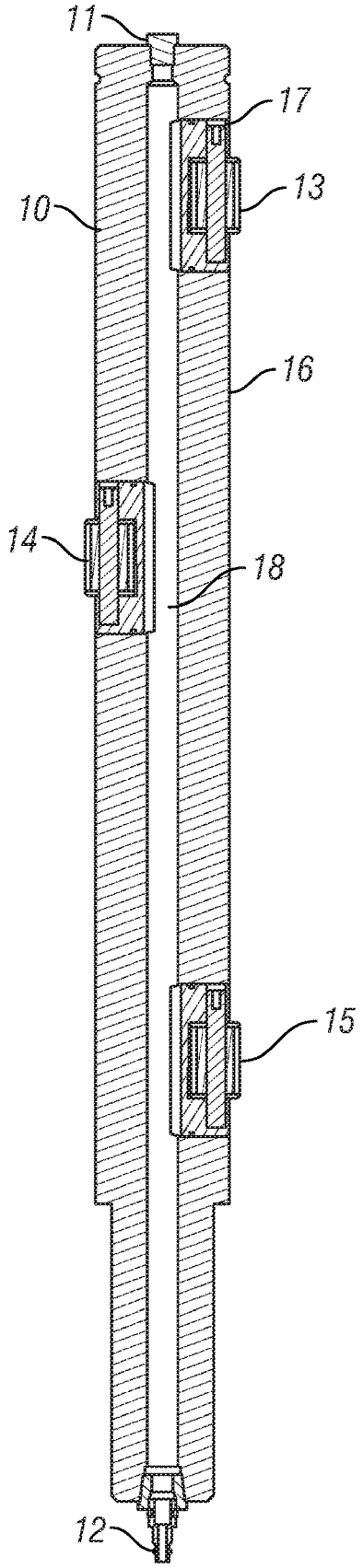
FIG. 3 shows a side view of a rotary expander tool adapted to remove conduit from a wellbore.

FIG. 3 shows a further embodiment of a rotary expander tool adapted to fracture materials outside a conduit to facilitate removing a conduit from a wellbore. The rotary expander tool 10 has a proximate end 11 and a distal end 12 adapted to be implemented within a downhole assembly. A plurality of rotatable biasing elements 13, 14, 15 are disposed diametrically along an axial plane of rotary expander tool 10.

As shown, rotatable biasing elements 13, 14 and 15 may extend radially outward from a cylindrical body 16 of rotary expander tool 10 and may be rotatable about a longitudinal axis 17 existing radially inward from cylindrical body 16. A net outward force may deploy one or more of rotatable biasing elements 13, 14 and 15 radially outward from the center axis of rotary expander tool 10 to contact a conduit. The net outward force may be generated from within a through bore 18 of cylindrical body 16. Alternatively, the net outward force may be generated by means disposed along the longitudinal axis 17 existing radially inward from an outer circumference of cylindrical body 16.

Figure 4:
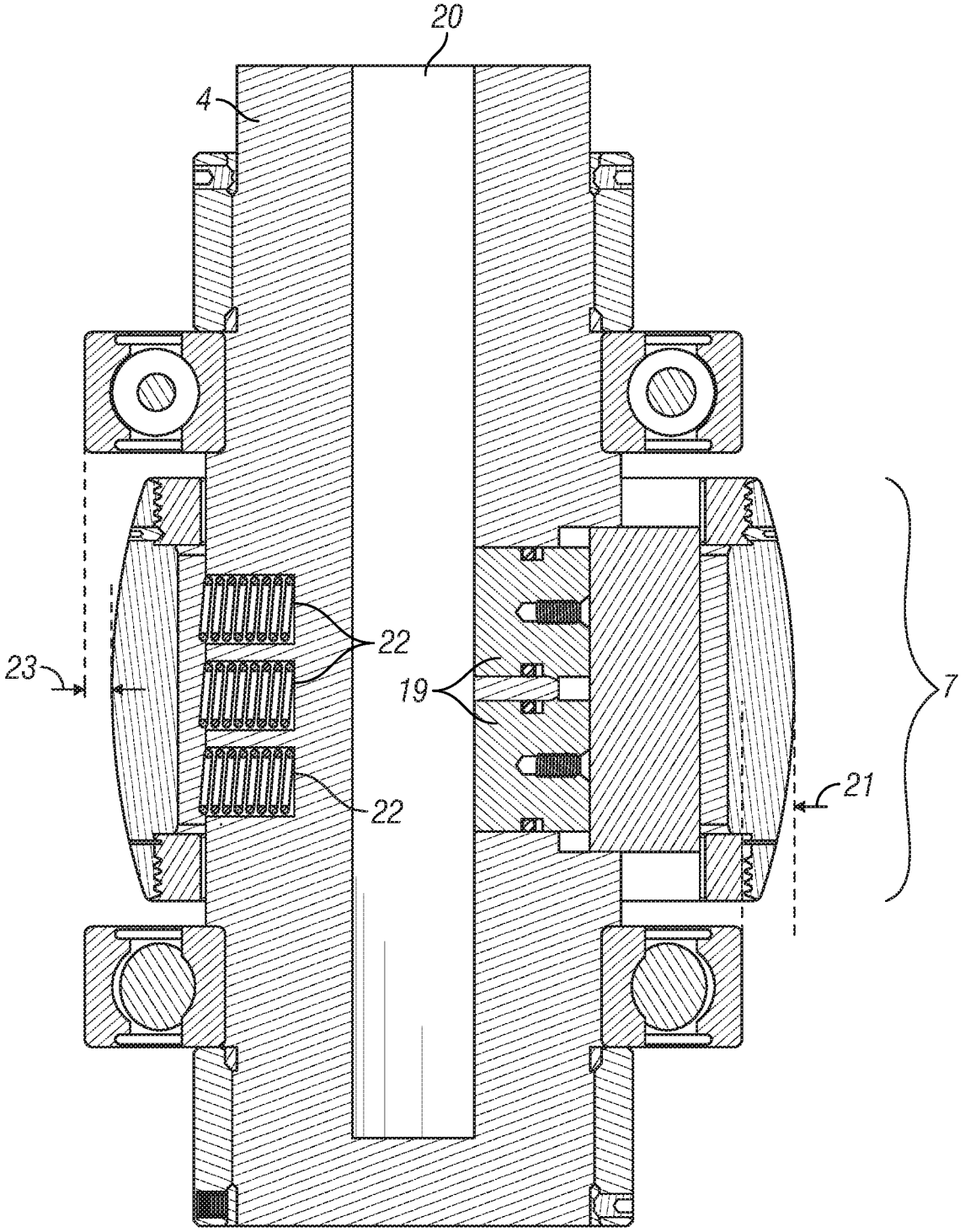
FIG. 4 shows a side view of a rotary biasing element that has been deployed in accordance with an embodiment according to the present disclosure.

FIG. 4 depicts a method of deploying a rotatable biasing element in accordance with one embodiment. A rotatable biasing element 7 is disposed circumferentially around a rotary expander tool 4. Extension means 19 are forced outward from a through bore 20 of the rotary expander tool 4 with a force sufficient to cause the rotatable biasing element 7 to extend radially outward from an outer radius of the rotary expander tool 4 by an expansion distance 21. The expansion distance 21 is sufficient to cause the rotatable biasing element to contact an inner radius of a conduit. Compression means 22 provide for the compression of rotatable biasing element 7 radially inward from an outer radius of rotary expander tool 4 by a compression distance 23. An axial torque is applied to the rotary expander tool 4, causing the rotary expander tool to rotate about its longitudinal axis. The rotation of the rotary expander tool may cause rotational movement of the point of contact between the radially extended portion of rotatable biasing element 7 and the inner radius of the conduit.

Figure 5:
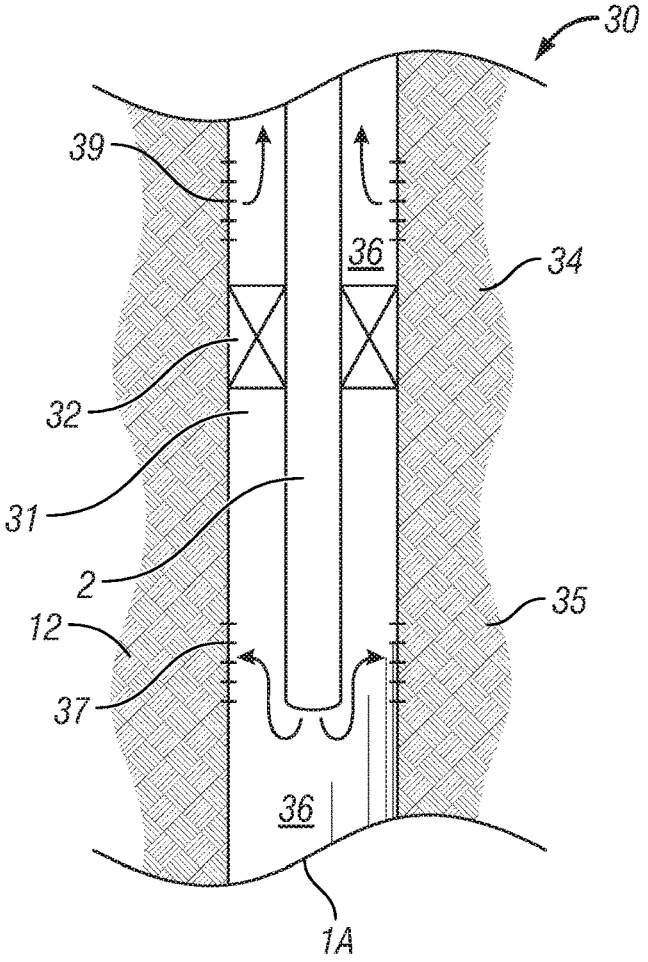
FIG. 5 shows an example embodiment of a "perforate and wash" method to remove fractured material in a wellbore annulus.

In some embodiments, certain actions may be taken after fracturing and/or disintegrating solids outside the inner conduit 2. Referring to FIG. 5, the wellbore 1 is shown where only the inner conduit is disposed and cemented in place, i.e., at the bottom 1A of the wellbore 1. Solids such as cement 34 are shown in the annular space 35 between the wellbore 1 and the outer surface of the inner conduit 2. In the portion of the wellbore as illustrated in FIG. 5, there is no outer conduit (3 in FIG. 1). The wellbore and conduit configuration shown in FIG. 5 may extend any distance along the wellbore 1 including all the way to the surface. An upper set 39 of perforations may be made through the wall of inner conduit 2 may be made, using, for example, jet perforating guns, bullet perforating guns, a chemical cutter, plasma cutter, mechanical cutter or any other wellbore deployable device used to make through-openings in the wall of a well conduit. At an axially spaced apart location along the inner conduit 2 a lower set 37 of perforations made be made through the wall of the inner conduit 2. A circulation tool 31 comprising an annular seal (packer) 32 may be extended into and set in place in the inner conduit 2. Fluid 36 may be pumped through the circulation tool 31 below the packer 32 where such fluid may move into the lower set 37 of perforations. The fluid 36 may remove fractured and/or disintegrated solids 34, which may then move into the upper set 39 of perforations and be lifted to the surface through the inner conduit 2.

Figure 6:
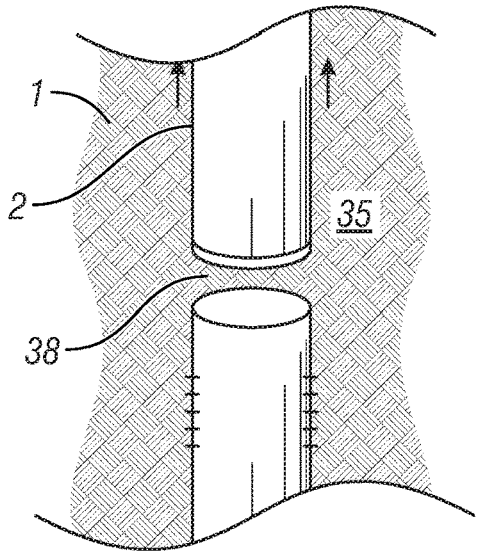
FIG. 6 shows an example embodiment of removing wellbore conduit after cutting the conduit.

After the solids 34 have been partially or completely removed, and referring to FIG. 6, the inner conduit 2 may be cut, as shown at 38, using, for example, well known conduit cutting devices such as jet cutters, chemical cutters or mechanical cutters. The inner conduit 2 may then be moved upwardly, e.g., from the surface using any hoisting apparatus known in the art, to remove it through the annular space 35 between the inner conduit 2 and the wellbore 1. In some embodiments, the operations shown in FIGS. 5 and 6 may be performed in any part of the wellbore comprising an inner conduit and an outer conduit as explained with reference to FIG. 1.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for recovering a conduit from a wellbore, comprising:

positioning within the conduit an expander tool comprising at least one biasing element;

exerting a force against the at least one biasing element, rotating the biasing element and moving the biasing element longitudinally to circumferentially and longitudinally movably radially expand the conduit to an amount sufficient to fracture solids outside of and in contact with the conduit, and fracturing the solids; and wherein either, the radially expanding is limited to an amount such that after plastic deformation the conduit is freely movable longitudinally along the wellbore, or the radially expanding is limited such that a net circumferential stress exerted against the conduit does not exceed a material yield strength of the conduit, wherein radial expansion of conduit remains elastic.

2. The method of claim 1 further comprising removing the conduit from the wellbore.

3. The method of claim 1 wherein the solids comprise at least one of cement, mud solids, formation solids, dissolved solids, barite weighting materials or organic materials.

4. The method of claim 1 wherein the conduit is a casing, tubular, conductor or liner.

5. The method of claim 4 wherein at least part of the conduit is circumscribed by a second conduit.

6. The method of claim 1 wherein the expander tool is rotatable about its longitudinal axis.

7. The method of claim 1 wherein the at least one biasing element is rotatable about a longitudinal axis of the expander tool.

8. The method of claim 7 further comprising rotating the at least one biasing element about a circumference of the expander tool.

9. The method of claim 7 further comprising disposing the at least one biasing element diametrically along an axial plane of the expander tool.

10. The method of claim 7 further comprising disposing a plurality of biasing elements radially around a center axis of the expander tool.

11. The method of claim 7 wherein a plurality of biasing elements extend radially outward from an outer circumference of the expander tool.

12. The method of claim 7 wherein an axis of rotation of the at least one of the biasing element is oriented at an angle with respect to a longitudinal axis of the expander tool in order to provide an axial force component in a direction of the wellbore conduit.

13. The method of claim 1 wherein the exerting is in an outward radial direction.

14. The method of claim 1 wherein the exerting comprises a longitudinal component.

15. The method of claim 1 wherein the force is exerted by means located within a through bore of the expander tool.

16. The method of claim 1 wherein the force is exerted by means disposed along a longitudinal axis existing radially inward from an outer radius of the expander tool.

17. The method of claim 1, further comprising applying a torque to the expander tool.

18. The method of claim 1 further comprising connecting the expander tool to a downhole assembly.

* * * * *